United States Patent [19]

Lutz

[11] 4,304,494

[45] Dec. 8, 1981

[54] SLIP-ON SHROUD FOR ASPHALT MIXER PADDLE

[75] Inventor: David L. Lutz, Loomis, Calif.

[73] Assignee: Kenco Engineering, Inc., Roseville, Calif.

[21] Appl. No.: 125,341

[22] Filed: Feb. 28, 1980

[51] Int. Cl.[3] ..... B01F 7/04; B28C 5/14

[52] U.S. Cl. ..... 366/343; 366/64; 366/325; 416/224

[58] Field of Search ..... 366/64–67, 366/325, 343; 416/222, 224

[56] References Cited

U.S. PATENT DOCUMENTS

| | | | |
|---|---|---|---|
| 2,692,563 | 10/1954 | Kovacs | 416/222 |
| 3,738,774 | 6/1973 | Lutz | 416/222 X |
| 3,773,436 | 11/1973 | Lutz | 366/65 X |
| 4,032,258 | 6/1977 | Snell | 416/222 X |

FOREIGN PATENT DOCUMENTS

| | | | |
|---|---|---|---|
| 894764 | 4/1962 | United Kingdom | 366/65 |

*Primary Examiner*—Philip R. Coe

*Attorney, Agent, or Firm*—Jack M. Wiseman; Francis W. Anderson

[57] ABSTRACT

A slip-on shroud to protect the shank of a mixing paddle of an asphalt mixer. The shroud is disposed on the shank and is formed with a generally triangular cross-sectional area to protect the front of the shank while reducing the quantity of material used to form the shroud and is formed with a generally triangular opening to receive the shank. The shroud is also formed with flanges confronting the opening to retain the shroud on the shank while reducing the quantity of material required to hold the shroud on the shank.

9 Claims, 7 Drawing Figures

SLIP-ON SHROUD FOR ASPHALT MIXER PADDLE

BACKGROUND OF THE INVENTION

The present invention relates in general to shrouds for protecting the shank of mixer paddles of a mixer, such as an asphalt mixer, and, more particularly, to a slip-on shroud for protecting the shank of a mixer paddle of a mixer, such as an asphalt mixer.

In the patent to Kenneth V. Lutz, U.S. Pat. No. 3,738,774, issued on June 12, 1973, for Asphalt Mixer Tip and Shank Assembly, there is disclosed a slip-on shroud mounted on each end of a shank of a mixer paddle radially inwardly of the mixer tips. The slip-on shroud has a generally rectangular cross-sectional area and the opening thereof to receive the shank has a generally rectangular cross-sectional area.

The patent to David L. Lutz, U.S. Pat. No. 3,773,436, issued on Nov. 20, 1973, for Shroud For Asphalt Mixer Paddle discloses a shroud for an asphalt mixer paddle to protect the shank of the mixer paddle. The shroud is attached to a mixer tip.

The patent to Stafford, U.S. Pat. No. 888,199, issued on May 19, 1908, for Concrete Mixer discloses a plate adjustably positioned along a shank of a mixing blade. The plate is retained in the adjusted position by a nut and bolt arrangement securing the plate to the shank. The plate is grooved so that it receives the shank and is adjustably movable therealong. The plate and groove have generally rectangular cross-sectional areas.

SUMMARY OF THE INVENTION

A slip-on shroud disposed on a shank of a mixing paddle of a mixer, which shroud has a generally triangular cross-sectional area to protect the front of the shank while reducing the quantity of material used to form the shroud and is formed with a generally triangular opening to receive the shank. Flanges confronting the opening retain the shroud on the shank while reducing the quantity of material required to hold the shroud on the shank.

By virtue of the present invention, the shroud of the present invention protects the front of the shank of a mixing paddle while minimizing the quantity of metal used to form the shroud and also receives the shank in a slip-on manner and retains the shroud on the shank while minimizing the material required to hold the shroud on the shank.

DESCRIPTION OF THE PREFERRED EMBODIMENT

Figure 1:
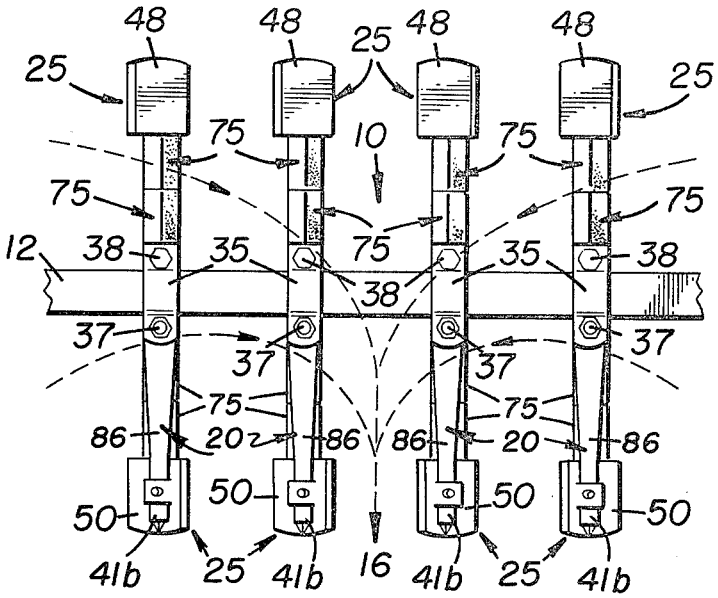
FIG. 1 is a fragmentary, diagrammatic elevation view of a mixer shaft with mixer paddles mounted thereon of an asphalt mixer plant, which mixer paddles include slip-on shrouds embodying the present invention.
Figure 2:
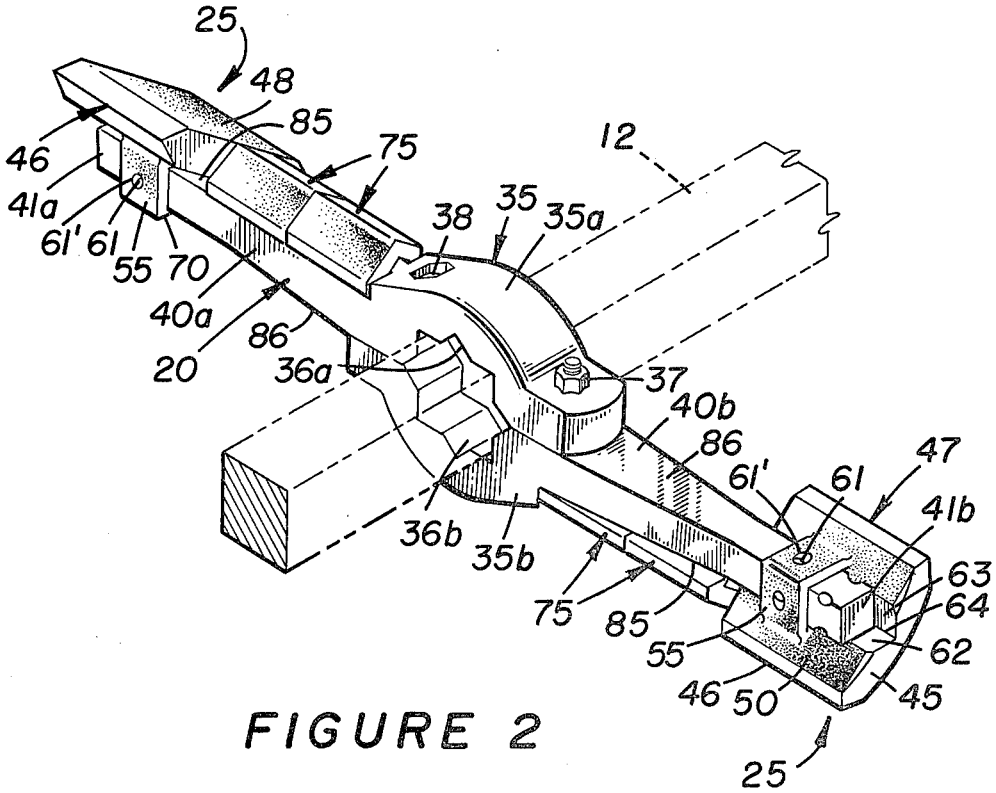
FIG. 2 is a perspective view of a mixer paddle mounted on the mixer shaft, which mixer paddle includes slip-on shrouds embodying the present invention.
Figure 3:
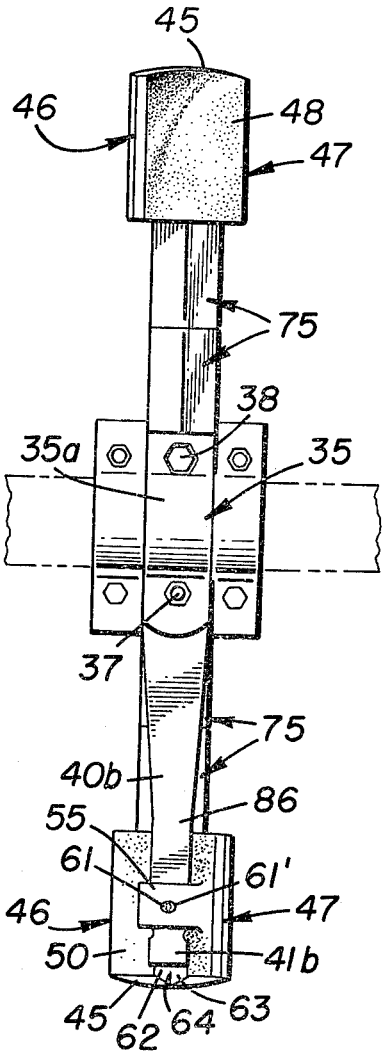
FIG. 3 is a front elevation view of a mixer paddle with slip-on shrouds embodying the present invention.
Figure 4:
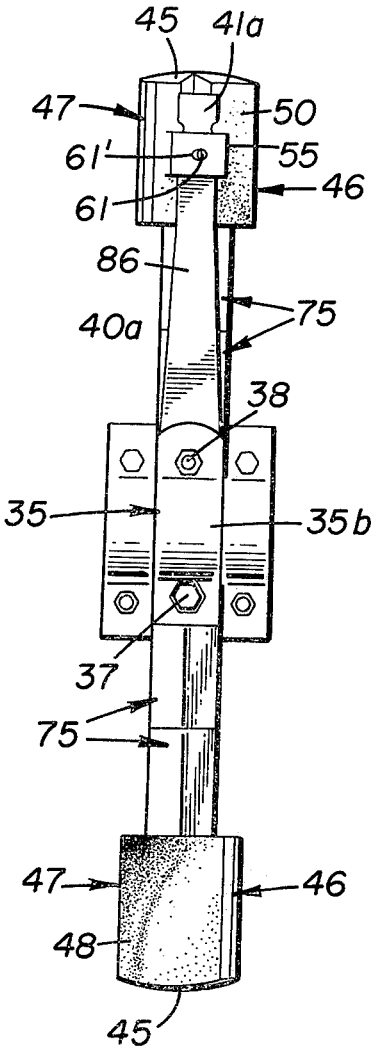
FIG. 4 is a rear elevation view of the mixer paddle shown in FIG. 3.

Illustrated in FIG. 1 is a rotor 10 which is employed as an asphalt mixer for mixing ingredients of aggregate and liquid asphalt or other cementing material commonly found in asphalt mixing plants. The rotor 10 includes a drive shaft 12 with a plurality of shanks 20 clamped thereto and projecting therefrom.

For explanation purposes, it may be viewed that the dotted lines in FIG. 1 represent the path of the mixture travelling toward an exit 16, at which point the mixture is to be discharged after the mixing operation is completed. The shanks 20 are universal or interchangeable and may be used either as a right hand shank or a left hand shank. At the distal ends of the shanks 20 are mounted conventional and well-known pugmill or mixer tips 25. The mixer tips 25 are universal or interchangeable and can be used either as a right hand mixer tip or a left hand mixer tip. The rotation of the rotor 10 simultaneously mixes the liquid asphalt and aggregate while urging the mixture toward the exit 16.

Each of the shanks 20 include a separable hub 35 having detachable hub halves 35*a* and 35*b*. Confronting recessed portions 36*a* and 36*b* of the hub halves 35*a* and 35*b*, respectively, form complementary jaws for gripping the drive shaft 12. In the exemplary embodiment, the cross-sectional area of the drive shaft 12 is square or quadrature, and the walls of the recesses 36*a* and 36*b* are shaped to accommodate a shaft with a square or quadrature cross-sectional area. Suitable nuts and bolts 37 and 38 interengage complementary hub halves 35*a* and 35*b* and clamp the shanks 20 in fixed relation to the drive shaft 12 for rotation therewith.

Projecting radially outward from the hub half 35*a* is a shank blade 40*a* that is formed integrally therewith. In a similar manner, projecting radially outward from the hub half 35*b* is a shank blade 40*b* formed integrally therewith. The shank blades 40*a* and 40*b* reduce in cross-sectional area as the blades progress from the proximal ends to the distal ends 41*a* and 41*b*. At the distal ends 41*a* and 41*b* of the shank blades 40*a* and 40*b*, respectively, the cross-sectional areas are square or quadrature. Intermediate, the portions of the shank blades 40*a* and 40*b* received by the hub halves 35*a* and 35*b* and the portions received by the mixer tips 25, the shank blades 40*a* and 40*b* are four-sided with the opposite corners thereof extending centrally in the longitudinal direction of the shank blades.

Each mixer tip 25 comprises an arcuate top wall 45. Extending from the top wall 45 are end walls 46 and 47. It is the end walls 46 and 47 that provide the leading and trailing edges. The end wall 46 includes a pair of tapered surfaces that meet at a crown, and the end wall 47 includes a pair of tapered surfaces that meet at a crown. A rear wall 50 also joins the end walls 46 and 47, and is disposed in parallel with the front wall 48.

The rear wall 50 has projected outwardly therefrom an integrally formed ear 55, which includes angularly disposed walls. The ear 55 is formed with a recess that is defined by angularly disposed walls that are at right angles to one another. The walls defining the recess of the ear 55 are parallel with the angularly disposed walls. Formed in the rear wall 50 is a second recess that confronts the previously described recess and is defined by angularly disposed walls that are at right angles to one another. The cross-sectional area of each of the recesses is square or quadrature and receives the distal end of the shank blade. As previously described, the distal end of the shank blade has a square or quadrature cross-sectional area. A bore 61' is formed in the ear 55 and passes through the angularly disposed walls. A suitable spring steel roll pin 61 is received by the bore 61' and expands to fix the mixer tip 25 to the shank 20.

The rear wall 50 is also formed with centrally located recessed, tapered walls 62 and 63 that join in a vertex 64. Intermediate the ear 55 and the walls 62 and 63 are recessed, right angular walls. The rear wall 50 is thus streamlined with smooth connecting surfaces to reduce friction and wear and tear.

Mounted on each shank blade 40*a* and 40*b* intermediate the mixer tip 25 thereof and the hub half 35*a* and 35*b* thereof is at least one slip-on shroud 75 embodying the present invention. Thus, the slip-on shrouds 75 are placed on the shanks 20 radially inward from the mixing tip 25 and radially outward of the hub 35 to protect the front portions of the shank 20 against excessive wear and tear.

Figure 5:
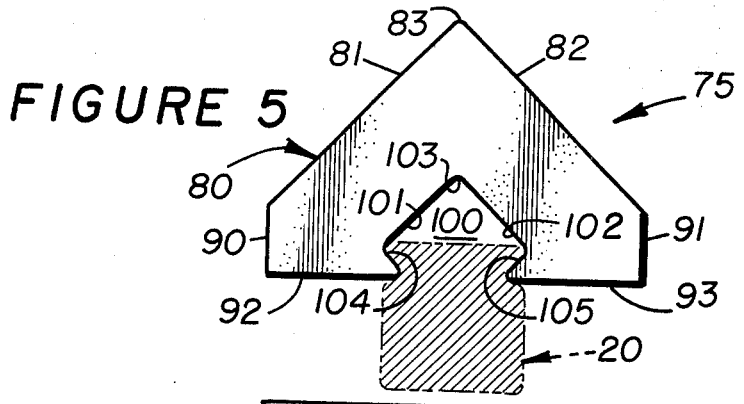
FIG. 5 is an end elevation view of the slip-on shroud embodying the present invention.
Figure 6:
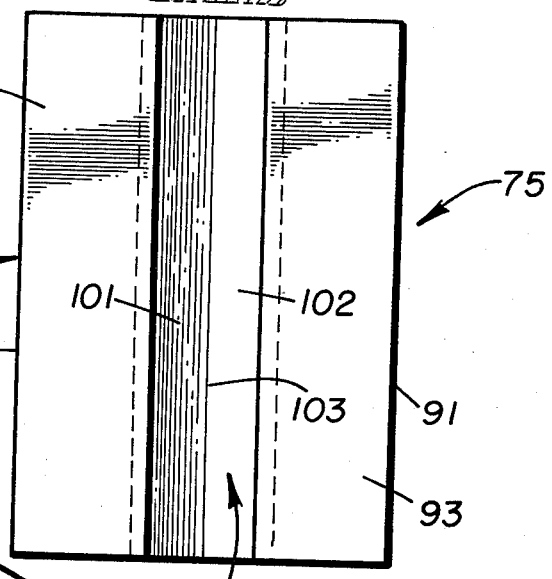
FIG. 6 is a bottom view of the slip-on shroud shown in FIG. 5.
Figure 7:
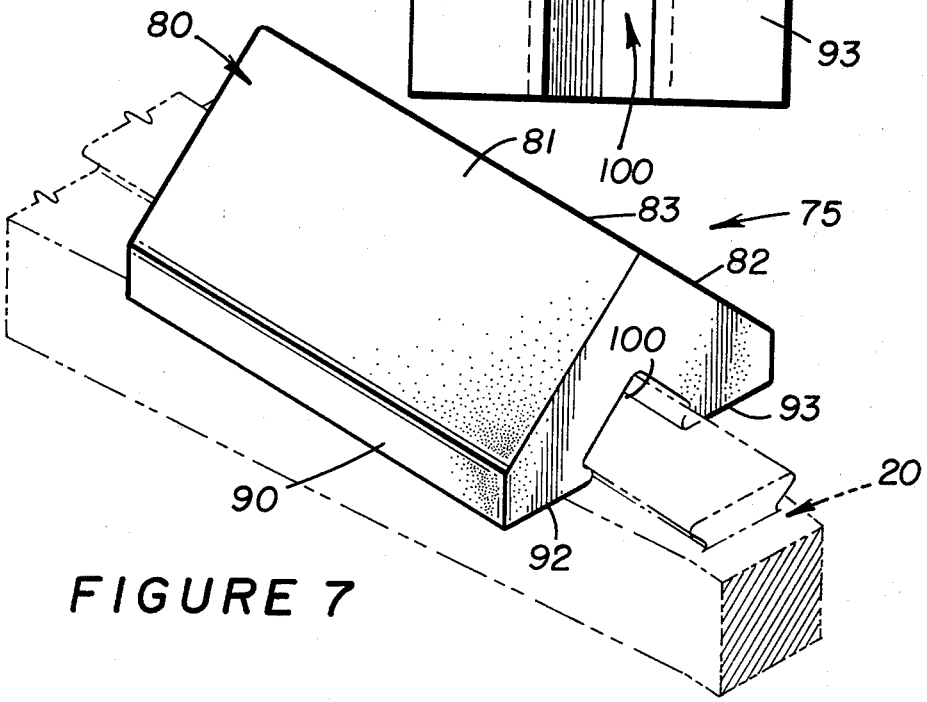
FIG. 7 is a perspective view of the slip-on shroud shown in FIGS. 5 and 6 illustrated mounted on a mixer paddle shank shown in phantom lines.

Each shroud 75 comprises a body 80 having a generally triangular cross-sectional area (FIG. 5). Forming the body are walls 81 and 82 which are disposed at right angles to one another and meet at a vertex 83. The walls 81 and 82 are disposed in front of the associated shank blade to protect the front of the associated shank blade from excessive wear and tear from abrasive material contacting the front of the shank blade. The front of the shank blade is that portion of the shank blade that serves to urge the mixture of liquid asphalt and aggregate toward the exit 16. The front of the shank blades are shown in the figures by the reference numeral 85. The opposite or rear portion of the shank blades have been designated by the reference numeral 86.

Extending from ends of the walls 81 and 82 opposite from the vertex 83 are parallel walls 90 and 91, respectively. Projecting inwardly from the ends of the walls 90 and 91, respectively, opposite from the ends thereof joining the walls 81 and 82, are aligned, spaced apart walls 92 and 93. The walls 92 and 93 are at right angles to the walls 90 and 91. The cross-sectional area of each of the shrouds 75 is considered to be generally triangular in that the walls 81, 82, and 91–92 appear to form a generally triangular configuration.

Each of the shrouds 75 is also formed with a central opening 100 in the body 80. The central opening 100 has a generally triangular cross-sectional area to receive the associated shank blade for movement therealong in the longitudinal direction of the shank blade. The shroud 75 is slipped onto the associated shank blade from the free end thereof before the mixing blade 25 is attached thereto. The shroud 75 is adjustably moveable along the associated shank blade along the longitudinal direction thereof or the radial direction relative to a mixing paddle.

The central opening 100 for receiving the associated shank blade is formed by the space between the confronting sides of the walls 92 and 93. Also defining the central opening 100 are interior walls 101 and 102 of the body 80, which are disposed at right angles to one another. The wall 101 is parallel to the wall 81; and a vertex 103 is parallel to the vertex 83. Projecting inwardly from the wall 101 is a substantially right angle flange 104. Similarly, a flange 105 projects inwardly from the wall 102 at right angles thereto. The flanges 104 and 105 retain the shroud 75 on the associated shank blade. While the shroud 75 is moveable along the associated shank blade in the longitudinal direction thereof to be slipped on and off from the associated shank blade or to be adjustably positioned therealong, the shroud 75 is retained on the associated shank blade by the flanges 104 and 105.

Thus, the mixer tip 25 and the hub 34 restrain the movement of the associated shrouds 75 in the radial direction relative to the mixer paddle shank 20, when the mixer tips 25 are secured by the free ends of the paddle shank 20. The opening 100 of the shroud 75 receives the confronting upper section of the shank blade in a dove-tail manner (FIG. 5) with the flanges 104 and 105 projecting toward the gap between the walls 92 and 93 to retain the shroud 75 on the associated shank blade.

The slip-on shrouds 75 are placed on the distal ends of the shank 20 with the walls 81 and 82 thereof facing toward the front portions of the shank 20 to protect the front portions 85 of the shank 20 against excessive wear and tear. The shrouds 75 slip onto the distal ends of the shank 20 and slidably engage the blades of the shank 20. The shrouds 75 are limited in the extent of their movement toward the proximal ends of the shank 20 by the hub 35. After the mixer tips 25 are mounted on the distal ends of the shank 20, the mixer tips 25 limit the extent of the movement of the shrouds 75 toward the distal end of the shank blades.

In use, the blades 40*a* and 40*b* are placed with the recesses 36*a* and 36*b* of the hub halves 35*a* and 35*b* confronting the drive shaft 12 and with the walls of the recesses 36*a* and 36*b* embracing in clamping engagement the drive shaft 12. The nuts and bolts 37 and 38 receive the hub halves 35*a* and 35*b* together to secure the shank 20 in fixed relation to the drive shaft 12 for rotation therewith.

Now, the slip-on shrouds are placed on the distal ends of the shank 20. The mixer tips 25 are then secured to the distal ends of the shank 20. Toward this end, the distal ends 41*a* and 41*b* of the shank 20 are received respectively by ears 55 of the mixer tips 25 and by the confronting recesses 60 of the mixer tips 25. After the mixer tips 25 are mounted on the shank 20, the roll pins 61 are inserted into the ears 55 for securing the mixer tips 25 to the shank 20. The mixer tips 25 limit the movement of the shrouds 75 toward the distal ends of the shanks 20.

I claim:

1. A shroud for protecting a shank having a mixer assembly comprising an elongate body having:

(a) a pair of outer longitudinally-extending walls disposed at an angle relative to each other and joined at a centrally located, longitudinally disposed vertex;

(b) a pair of inner longitudinally-extending walls spaced inwardly from said outer walls and disposed at an angle relative to each other, said inner walls being joined at a centrally located, longitudinally disposed vertex; and (c) a rear wall including oppositely directed, confronting flanges extending from said inner walls, respectively, and having wall surfaces spaced from said inner walls, said walls being effective to define a socket adapted to receive a mounting portion of a shank, said inner walls being disposed in parallel relation with said outer walls, respectively, and said longitudinally disposed vertices being disposed in parallel relation with each other.

2. A shroud as claimed in claim 1 wherein said outer walls are disposed at right angles to one another and said inner walls are disposed at right angles to one another.

3. A shroud as claimed in claim 2 wherein said flanges are disposed at right angles to said inner walls, respectively.

4. A mixer assembly for attachment to a rotary drive shaft comprising:

(A) a shank comprising a hub having a central opening for receiving the drive shaft to mount said shank on the drive shaft for rotation therewith, and a blade projecting radially outward from said hub and having a forward wall that faces in the direction of movement of the shank during rotation of said drive shaft, (B) a mixer tip mounted on the distal end of said blade; and (C) an elongated slip-on shroud mounted on the forward wall of said blade entirely forwardly thereof and between said hub and said mixer tip, said slip-on shroud being limited in movement in the radial direction in which said blade projects by said hub and said mixer tip; said shroud comprising:

(a) a pair of outer longitudinally-extending walls disposed at an angle to each other and joined at a centrally located, longitudinally disposed vertex for protecting the forward wall of said blade, said vertex extending in the radial direction in which said blade projects and intermediate the sides thereof, (b) inner longitudinally-extending walls spaced inwardly from said outer walls toward the forward wall of said blade, said inner walls being joined at a centrally located, longitudinally disposed vertex for defining an opening to receive said blade for movement therealong in the radial direction in which said blade projects, (c) oppositely directed, confronting flanges extending from said inner angularly disposed walls, respectively, for retaining said shroud on the forward wall of said blade.

5. A mixer assembly as claimed in claim 4 wherein said inner walls are disposed in parallel relation with said outer walls, respectively, and said longitudinally disposed vertices are disposed in parallel relation intermediate the sides of said blade.

6. A mixer assembly as claimed in claim 5 wherein said outer walls are disposed at right angles to one another and said inner walls are disposed at right angles to one another.

7. A mixer assembly as claimed in claim 6 wherein said flanges are disposed at right angles to said inner walls, respectively.

8. A mixer assembly for attachment to a rotary drive shaft comprising a shank having a hub with a central opening adapted to receive the shaft in driving relation, said shank having a forward face projecting in the direction of rotary movement of said shank during rotation of said shaft, a shroud, and means providing a cooperating drive connection between said shroud and the forward face of said shank to effect rotary movement of said shroud with said shank, said shroud being disposed entirely forwardly of said forward face in the direction of movement of said shank.

9. A mixer assembly according to claim 8 wherein said drive connection includes a tongue integrally formed on the forward face of said shank and projecting forwardly therefrom, and a socket in said shroud for receiving said tongue in driving relation.

* * * * *